US005392021A

United States Patent [19]

Liao

[11] Patent Number: 5,392,021

[45] Date of Patent: Feb. 21, 1995

[54] ELECTROMAGNETIC MULTI-STAGE SWITCH

[76] Inventor: Kun-Sheng Liao, 11-6, Hsin - I Rd., Keelong, Taipei Country, Taiwan, Prov. of China

[21] Appl. No.: 195,396

[22] Filed: Feb. 14, 1994

[51] Int. Cl.[6] ..... H01H 51/34

[52] U.S. Cl. ..... 337/87; 337/91

[58] Field of Search ..... 368/62, 70; 335/78–89, 335/94, 95, 96, 97

[56] References Cited

U.S. PATENT DOCUMENTS 2,614,187 10/1952 Dorothea ..... 335/87

4,549,154 10/1985 Thoma ..... 335/87

*Primary Examiner*—Lincoln Donovan

*Attorney, Agent, or Firm*—Thomas M. Freiburger

[57] ABSTRACT

An electromagnetic multi-stage switch composed of a lower and an upper support seats, an electromagnetic coil, a rotary shaft, a restoring spring and a driving iron plate. A shaft member is fixedly disposed between the upper and lower support seats and a rotary shaft is axially movably fitted around the shaft member to axially move between the upper and lower support seats. The upper and lower support seats and rotary shaft are formed with corresponding driving teeth and engaging teeth. The rotary shaft has an outward extending flange-like insulative rotary disk formed with several through holes, whereby when the electromagnetic coil is energized, the same attracts the driving iron plate downward to drive the rotary shaft, and the driving teeth guide the rotary shaft to rotate the rotary disk, making an input contact contact with an output contact through the holes of the rotary disk so as to close a circuit, while when the electromagnetic coil is disenergized, the driving iron plate is restored to its original position by the restoring spring to open the circuit. The electromagnetic coil is repeatedly energized and disenergized for obtaining different patterns of electric output.

4 Claims, 6 Drawing Sheets

ELECTROMAGNETIC MULTI-STAGE SWITCH

BACKGROUND OF THE INVENTION

The present invention relates to a multi-stage switch, and more particularly to an electromagnetically controlled multi-stage switch in which a rotary disk is controllably rotated to control the contact between respective contacts for closing and opening circuits and achieving desired electric output.

A conventional electromagnetic switch includes an electromagnetic coil, whereby when the current of a relay passes through the coil to create a magnetic force, the coil attracts an iron plate with a contact plate, making the contact plate contact with other contact so as to achieve a switching effect. In such conventional switch, all the contact plates are associated together so that when the relay works, all the contact plates open or close together. When it is necessary to respectively open/close the contact plates, the above operation is unable to achieve the required movements.

SUMMARY OF THE INVENTION

It is a primary object of the present invention to provide an electromagnetic multi-stage switch which employs a specifically designed rotary disk formed with multiple through holes for controlling the opening/-closing of the contact plates. When the rotary disk is rotated to a position where the contact plates contact with each other through the through holes, a circuit is closed, while when the rotary disk is rotated to a position where the contact plates are separated by the rotary disk, the circuit is opened. By means of the operation of the rotary disk, the opening/closing of the contact plates can be respectively controlled.

The present invention can be best understood through the following description and accompanying drawing, wherein:

DETAILED DESCRIPTION OF THE PREFERRED EMBODIMENT

Figure 1:
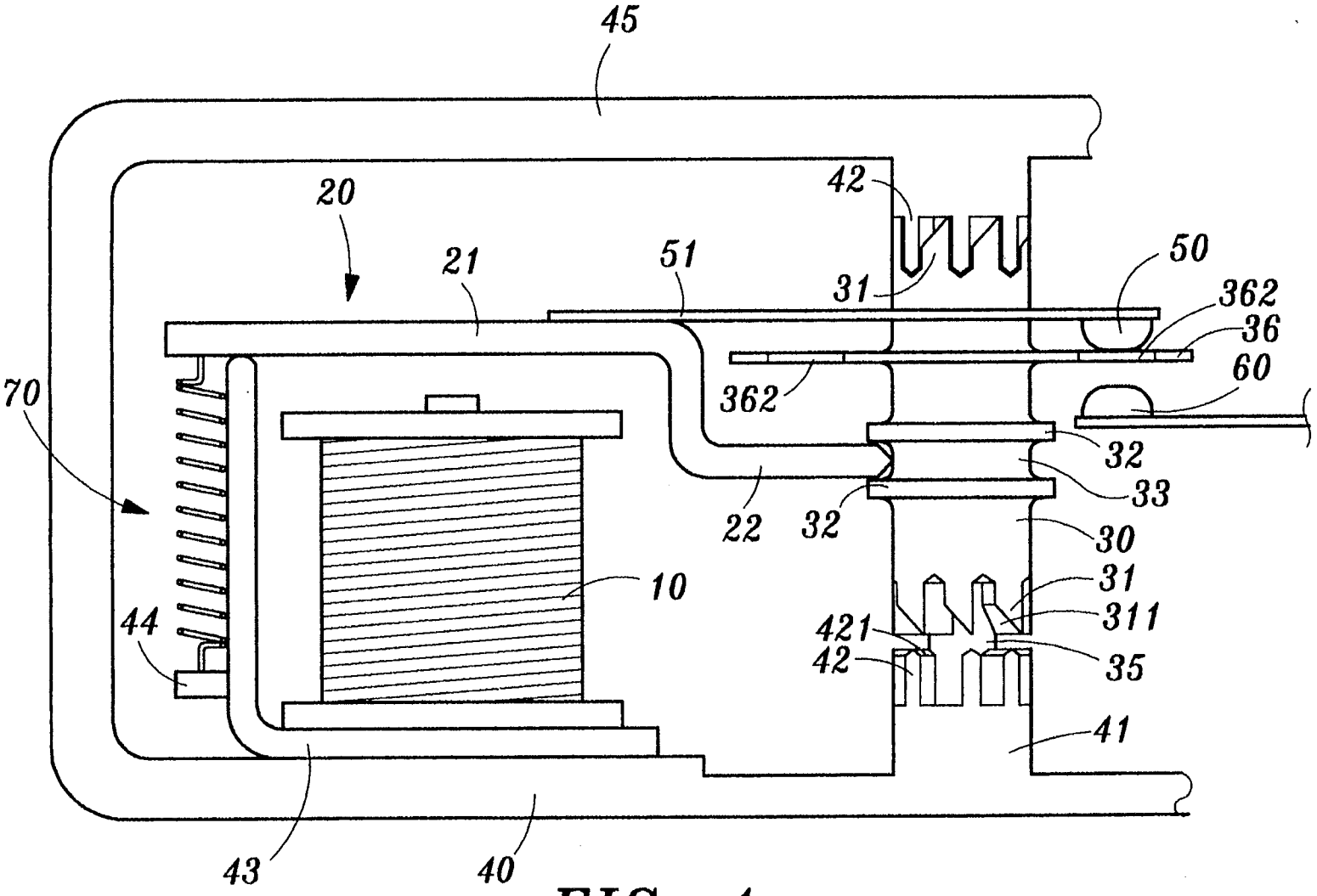
FIG. 1 shows the present invention in a not moving state.

Please refer to FIG. 1. The present invention includes a lower support seat 40 having a first hollow shaft 41 on one side, an upper support seat 45 having a second hollow shaft 41 corresponding to the first hollow shaft section 41, an L-shaped support lever 43 disposed on the other side of the lower support seat 40, a spring fixing seat 44 disposed beside the L-shaped support lever 43, an electromagnetic coil 10 disposed on the support lever 43 for attracting a driving iron plate 20 downward and a restoring spring 70 having a lower end fixed on the spring fixing seat 44 and an upper end connected with the driving iron plate 20.

An upper end of the support lever 43 serves as a fulcrum of the driving iron plate 20 so that the restoring spring 70 can exert a restoring force on one end of the driving iron plate 20 to lift the other end thereof. A shaft member 35 is fixedly disposed between the first and second hollow shafts 41 and a rotary shaft 30 made of insulative material is axially movably fitted around the shaft member 35 to axially move between the first and second hollow shafts 41. An upper end of the first hollow shaft 41 and a lower end of the second hollow shaft 41 are formed with multiple axial cuts defining multiple driving teeth 42. The rotary shaft 30 has multiple engaging teeth corresponding to the driving teeth 42. Each of the driving teeth 42 is formed with slant surfaces 421 on both sides and each of the engaging teeth 31 is formed with an inclined surface 311 for facilitating the engagement between the driving teeth 42 and the engaging teeth 31. When the electromagnetic coil is not powered on, the driving teeth 42 of the upper support seat 45 are engaged with the engaging teeth 31 of the rotary shaft 30.

Figure 2:
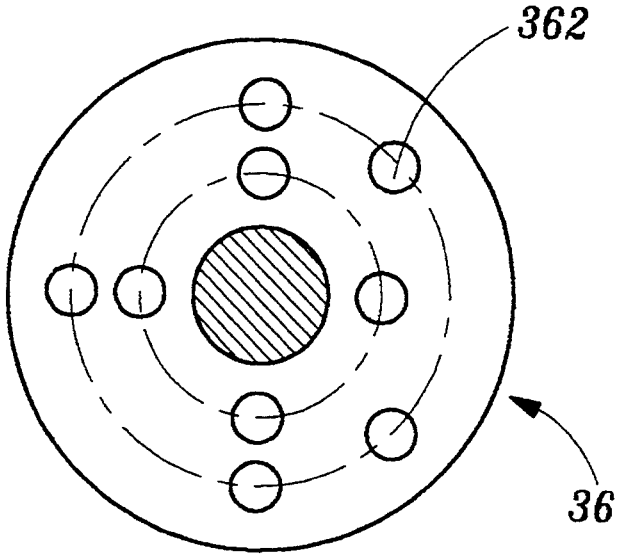
FIG. 2 is a top view of the rotary disk of the present invention.

The driving iron plate 20 is substantially Z-shaped, having an upper extending plate 21, a lower extending plate 22 and two 90 degrees bent sections connecting the upper and lower extending plates 21, 22. Several input contacts 50 are fixedly connected with the upper extending plate 21 via transverse levers 51 and an end of the lower extending plate 22 extends into an annular groove 33 defined by two annular projections 32 of the rotary shaft 30. Referring to FIG. 2, the rotary shaft 30 has an outward extending flange-like rotary disk 36. The rotary disk 36 is formed with several through holes 362 arranged at equal intervals or different intervals according to the requirements of a user. The input contacts 50 can go through the through holes 362 to contact with corresponding output contacts 60 for forming a circuit.

Figure 3:
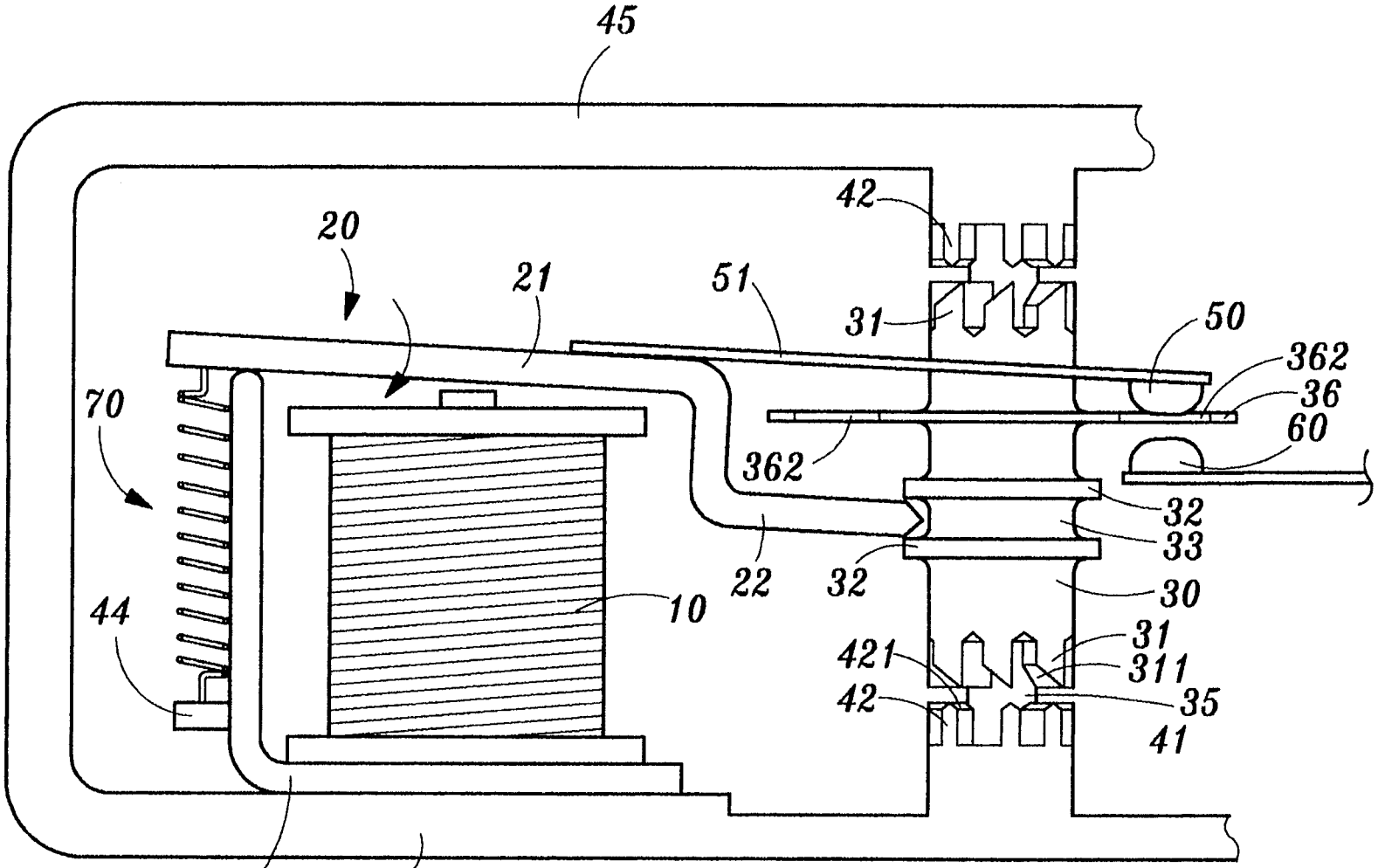
FIG. 3 shows the present invention in a moving state.

Please refer to FIG. 3. When the electromagnetic coil 10 is powered on and energized, the same will attract the driving iron plate 20 downward and the end of the lower extending plate 22 will drive the whole rotary shaft 30 to move downward. When the inclined surfaces 311 of the lower engaging teeth 31 of the rotary shaft 30 contact with the slant surfaces 421 of the driving teeth 42 of the lower support seat 40, the inclined surfaces 311 are guided and the rotary shaft 30 with the rotary disk 36 is rotated.

Figure 4:
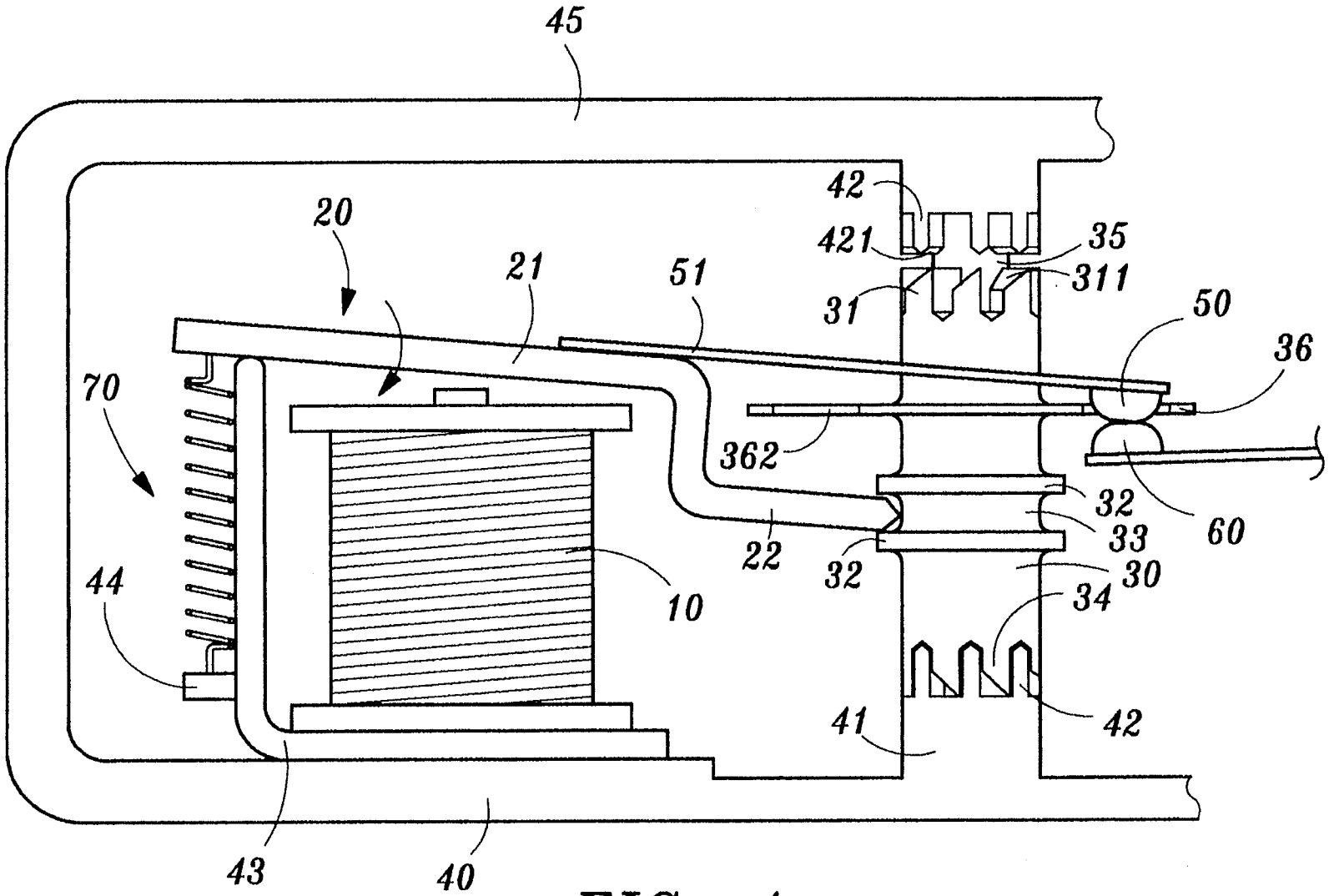
FIG. 4 shows the present invention in a after moving state.

Please refer to FIG. 4. When the driving teeth 42 are totally fitted into a locking end position between two adjacent engaging teeth 31, the input contact 50 contacts with the output contact 60 through the holes 362 of the rotary disk 36. The positions and number of the holes 362 are designed according to actual requirements so that the input and output contacts 50, 60 can be respectively directly controlled, making some specific contacts only contact with each other at a specific time.

Figure 6:
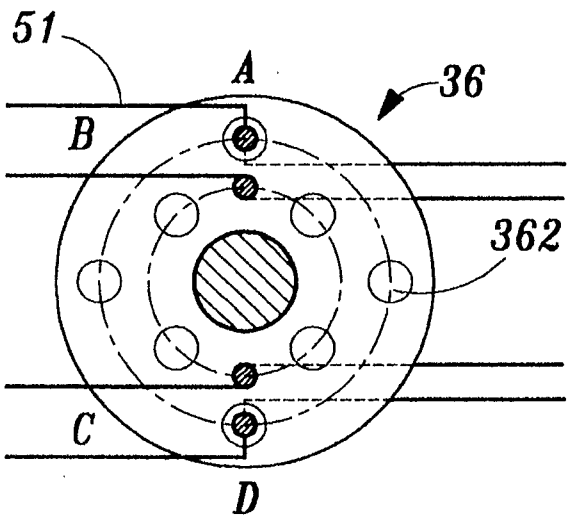
FIG. 6 shows the movement of the rotary disk at the first energization.
Figure 5:
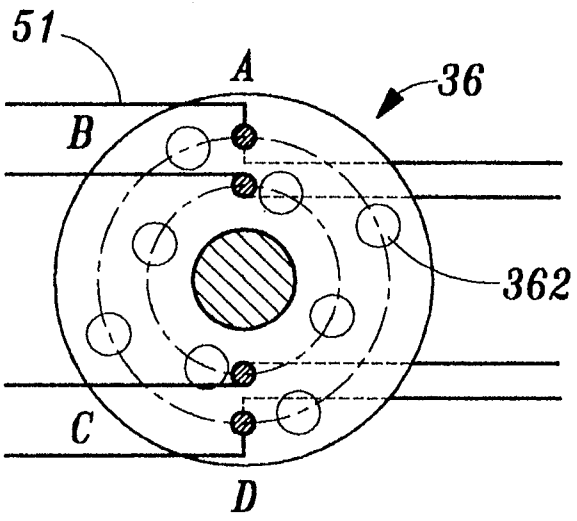
FIG. 5 is a top view of the rotary disk in a not moving state.
Figure 8:
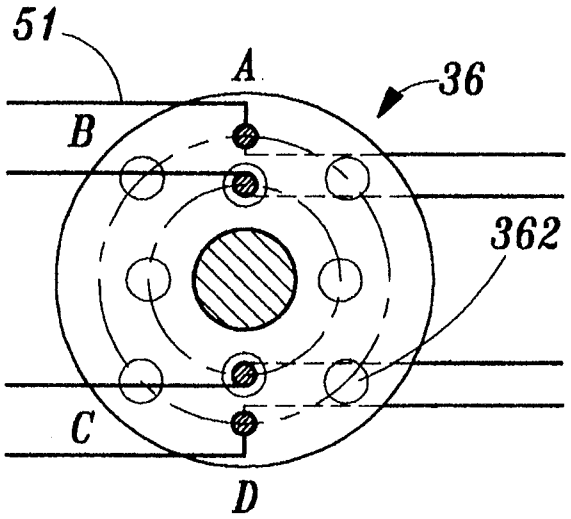
FIG. 8 shows the movement of the rotary disk at the second energization.
Figure 7:
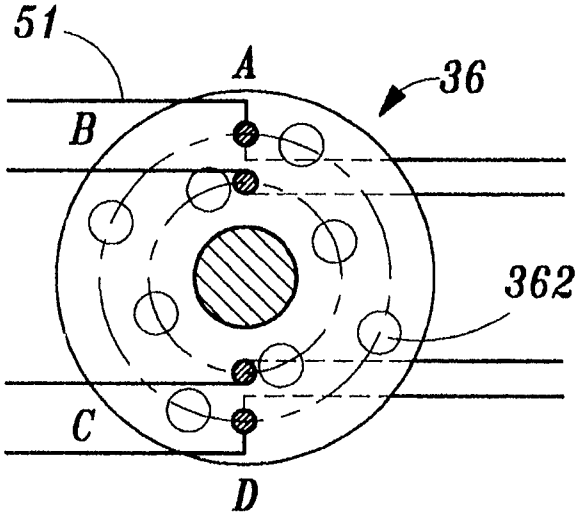
FIG. 7 shows the movement of the rotary disk at the first disenergization.

For example, a set of four circuits A, B, C and D are provided, wherein the circuits A and D are closed and the circuits B and C are opened at the first energization, while at second energization, the operation is reversed. Such movement is continuously repeated. The design of the rotary disk 36 and the contacts 50, 60 is shown in FIG. 5, wherein when the electromagnetic coil 10 is not energized, all the contacts fail to contact with one another at any hole 362. Eight engaging teeth 31 and eight driving teeth 42 are provided and spaced at 45 degree intervals and the driving teeth 42 of the upper support seat 45 are 22.5 degrees separated from the corresponding driving teeth 42 of the lower support seat 40, whereby when the electromagnetic coil 10 is first energized, the rotary shaft 30 is lowered into the locking end position and rotated through 22.5 degrees. At this time, the input contacts 50 contact with the output contacts 60 at some holes 362 of the rotary disk 36, making the circuits A and D closed and the circuits B and C opened as shown in FIG. 6. After the power for the electromagnetic coil 10 is cut off, the driving iron plate 20 is pulled by the restoring spring 70 to lift the rotary shaft 30 and rotate the same through 22.5 degrees. At this time, no contact contacts with the other at any hole 362 so that all the circuits are opened as shown in FIG. 7. When the electromagnetic coil 10 is second energized, the rotary shaft 30 will be again lowered and rotated through 22.5 degrees, making the circuits B and C closed and the circuits A and D opened as shown in FIG. 8. After the electromagnetic coil 10 is disenergized, all the circuits become opened as shown in FIG. 5. The procedure is repeated and different patterns of electric output can be obtained.

The above is only one embodiment of the present invention. The position and numbers of the holes 362 of the rotary disk 36 and the input and output contacts can be varied. Also, the numbers of the driving teeth 42 of the engaging teeth 31 can be changed to achieve various patterns of output.

It is to be understood that the above description and drawings are only used for illustrating one embodiment of the present invention, not intended to limit the scope thereof. Any variation and derivation from the above description and drawings should be included in the scope of the present invention.

What is claimed is:

1. A multi-stage switch comprising a lower support seat having a first hollow shaft on one side, an upper support seat having a second hollow shaft corresponding to said first hollow shaft section, an L-shaped support lever disposed on the other side of said lower support seat, a spring fixing seat disposed beside said L-shaped support lever, an electromagnetic coil disposed on said support lever for attracting a driving iron plate downward and a restoring spring having a lower end fixed on said spring fixing seat and an upper end connected with said driving iron plate, an upper end of said support lever serving as a fulcrum of said driving iron plate so that said restoring spring is able to exert a restoring force on one end of said driving iron plate to lift the other end thereof, a shaft member being fixedly disposed between said first and second hollow shafts and a rotary shaft made of insulative material being axially movably fitted around said shaft member to axially move between said first and second hollow shafts, an upper end of said first hollow shaft and a lower end of said second hollow shaft being formed with multiple axial cuts defining multiple driving teeth, said rotary shaft having multiple engaging teeth corresponding to said driving teeth, each of said driving teeth being formed with slant surfaces on both sides and each of said engaging teeth being formed with an inclined surface for facilitating engagement between said driving teeth and said engaging teeth, said driving teeth being capable of guiding said engaging teeth and rotating said rotary shaft, several input contacts being fixedly connected with said driving iron plate via transverse levers an end of said driving iron plate being connected with said rotary shaft, said rotary shaft having an outward extending flange-like insulative rotary disk formed with several through holes, whereby when said electromagnetic coil is energized, the same attracts said driving iron plate downward to drive said rotary shaft downward, and when said inclined surfaces of said lower engaging teeth of said rotary shaft contact with said slant surfaces of said driving teeth of said lower support seat, said inclined surfaces are guided and said rotary shaft with said rotary disk is rotated, making said input contact contact with said output contact through said holes of said rotary disk so as to close a circuit, while when said electromagnetic coil is disenergized, said driving iron plate is restored to its original position by said restoring spring and said rotary shaft is lifted to engage with said second hollow shaft of said upper support seat and the circuit become opened, said electromagnetic coil being repeatedly energized and disenergized for obtaining different patterns of output.

2. A switch as claimed in claim 1, wherein said shaft member restricts said rotary shaft to axially move between said first and second hollow shafts.

3. A switch as claimed in claim 1, wherein one end of said driving iron plate extends into an annular groove defined by two annular projections formed on a middle portion of said rotary shaft for driving said rotary shaft.

4. A switch as claimed in claim 1, wherein the positions and number of said holes of said rotary disk are variable according to requirement of use for forming multi-stage output.

* * * * *